US009851663B2

(12) United States Patent
Kobashigawa et al.

(10) Patent No.: US 9,851,663 B2
(45) Date of Patent: Dec. 26, 2017

(54) FIXING DEVICE AND IMAGE FORMING APPARATUS

(71) Applicants: Shohta Kobashigawa, Tokyo (JP); Kenji Ishii, Kanagawa (JP); Kazuhito Kishi, Kanagawa (JP); Takayuki Seki, Kanagawa (JP); Hiroshi Yoshinaga, Chiba (JP); Takashi Seto, Kanagawa (JP); Hiromasa Takagi, Tokyo (JP); Ippei Fujimoto, Kanagawa (JP); Hiroshi Seo, Kanagawa (JP); Takamasa Hase, Tokyo (JP); Kazunari Sawada, Tokyo (JP); Yasuhiko Ogino, Kanagawa (JP)

(72) Inventors: Shohta Kobashigawa, Tokyo (JP); Kenji Ishii, Kanagawa (JP); Kazuhito Kishi, Kanagawa (JP); Takayuki Seki, Kanagawa (JP); Hiroshi Yoshinaga, Chiba (JP); Takashi Seto, Kanagawa (JP); Hiromasa Takagi, Tokyo (JP); Ippei Fujimoto, Kanagawa (JP); Hiroshi Seo, Kanagawa (JP); Takamasa Hase, Tokyo (JP); Kazunari Sawada, Tokyo (JP); Yasuhiko Ogino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/144,055

(22) Filed: May 2, 2016

(65) Prior Publication Data

US 2016/0334742 A1 Nov. 17, 2016

(30) Foreign Application Priority Data

May 15, 2015 (JP) ..... 2015-100098
Mar. 29, 2016 (JP) ..... 2016-065865

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 2215/2035
See application file for complete search history.

(56) References Cited

U.S. PATENT DOCUMENTS 6,301,454 B1 * 10/2001 Nishida ..... G03G 15/2003 219/216
7,130,554 B2 * 10/2006 Takematsu ..... G03G 15/205 399/69

(Continued)

FOREIGN PATENT DOCUMENTS

JP 8-022216 1/1996
JP 2014-178370 9/2014

OTHER PUBLICATIONS

U.S. Appl. No. 15/010,012, filed Jan. 29, 2016.

(Continued)

*Primary Examiner* — Sevan A Aydin
(74) *Attorney, Agent, or Firm* — Oblon, McClelland, Maier & Neustadt, L.L.P.

(57) ABSTRACT

A fixing device includes a primary heater disposed opposite a fixing rotator to heat a circumferential span of the fixing rotator other than a fixing nip formed between the fixing rotator and a pressure rotator and a secondary heater disposed outboard from the primary heater in an axial direction of the fixing rotator to heat the fixing rotator at the fixing nip. The primary heater and the secondary heater heat a bi-heating span of the fixing rotator in the axial direction thereof. The secondary heater heats a mono-heating span of the fixing rotator in the axial direction thereof and generates a decreased amount of heat to be conducted to the bi-heating (Continued)

span of the fixing rotator. The decreased amount of heat is smaller than an increased amount of heat to be conducted to the mono-heating span of the fixing rotator that is heated by the secondary heater only.

20 Claims, 8 Drawing Sheets

(56) References Cited

U.S. PATENT DOCUMENTS 8,909,084 B2* 12/2014 Fujii ..... G03G 15/2042 399/330
2003/0059235 A1* 3/2003 Senda ..... G03G 15/2042 399/330
2003/0190170 A1* 10/2003 Hamada ..... G03G 15/205 399/69
2011/0129268 A1* 6/2011 Ishii ..... G03G 15/2053 399/333
2013/0209124 A1* 8/2013 Saito ..... G03G 15/2042 399/69
2015/0110531 A1* 4/2015 Takagi ..... G03G 15/206 399/329
2015/0261157 A1* 9/2015 Yamano ..... G03G 15/2053 399/329
2015/0331376 A1* 11/2015 Shimmura ..... G03G 15/2042 399/69
2016/0187823 A1* 6/2016 Seto ..... G03G 15/2082 399/329
2016/0223961 A1* 8/2016 Takagi ..... G03G 15/2053
2016/0223963 A1* 8/2016 Yoshinaga ..... G03G 15/2053
2016/0231672 A1* 8/2016 Seto ..... G03G 15/2053
2016/0238975 A1* 8/2016 Seki ..... G03G 15/2064
2016/0246228 A1* 8/2016 Fujimoto ..... G03G 15/2053
2016/0274510 A1* 9/2016 Hase ..... G03G 15/2042
2016/0274511 A1* 9/2016 Ogino ..... G03G 15/2053
2016/0274514 A1* 9/2016 Ishii ..... G03G 15/2053

OTHER PUBLICATIONS

U.S. Appl. No. 14/979,686, filed Dec. 28, 2015.
U.S. Appl. No. 14/992,643, filed Jan. 11, 2016.
U.S. Appl. No. 15/011,982, filed Feb. 1, 2016.
U.S. Appl. No. 15/013,827, filed Feb. 2, 2016.
U.S. Appl. No. 15/063,755, filed Mar. 8, 2016.
U.S. Appl. No. 15/011,886, filed Feb. 1, 2016.
U.S. Appl. No. 15/052,450, filed Feb. 24, 2016.
U.S. Appl. No. 15/063,769, filed Mar. 8, 2016.

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2015-100098, filed on May 15, 2015, and 2016-065865 filed on Mar. 29, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator to press against the fixing rotator to form a fixing nip between the fixing rotator and the pressure rotator. A primary heater is disposed opposite the fixing rotator to heat a circumferential span of the fixing rotator other than the fixing nip. A secondary heater is disposed outboard from the primary heater in an axial direction of the fixing rotator to heat the fixing rotator at the fixing nip. The primary heater and the secondary heater heat a bi-heating span of the fixing rotator in the axial direction of the fixing rotator. The secondary heater heats a mono-heating span of the fixing rotator in the axial direction of the fixing rotator and generates a decreased amount of heat to be conducted to the bi-heating span of the fixing rotator. The decreased amount of heat is smaller than an increased amount of heat to be conducted to the mono-heating span of the fixing rotator that is heated solely by the secondary heater of the primary heater and the secondary heater.

This specification further describes an improved image forming apparatus. In one exemplary embodiment, the image forming apparatus includes an image bearer to bear a toner image and a fixing rotator disposed downstream from the image bearer in a recording medium conveyance direction and rotatable in a predetermined direction of rotation. A pressure rotator presses against the fixing rotator to form a fixing nip between the fixing rotator and the pressure rotator. A primary heater is disposed opposite the fixing rotator to heat a circumferential span of the fixing rotator other than the fixing nip. A secondary heater is disposed outboard from the primary heater in an axial direction of the fixing rotator to heat the fixing rotator at the fixing nip. An electric circuit is electrically connected to the primary heater and the secondary heater to energize the primary heater and the secondary heater. The primary heater and the secondary heater heat a bi-heating span of the fixing rotator in the axial direction of the fixing rotator. The secondary heater heats a mono-heating span of the fixing rotator in the axial direction of the fixing rotator and generates a decreased amount of heat to be conducted to the bi-heating span of the fixing rotator. The decreased amount of heat is smaller than an increased amount of heat to be conducted to the mono-heating span of the fixing rotator that is heated solely by the secondary heater of the primary heater and the secondary heater.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
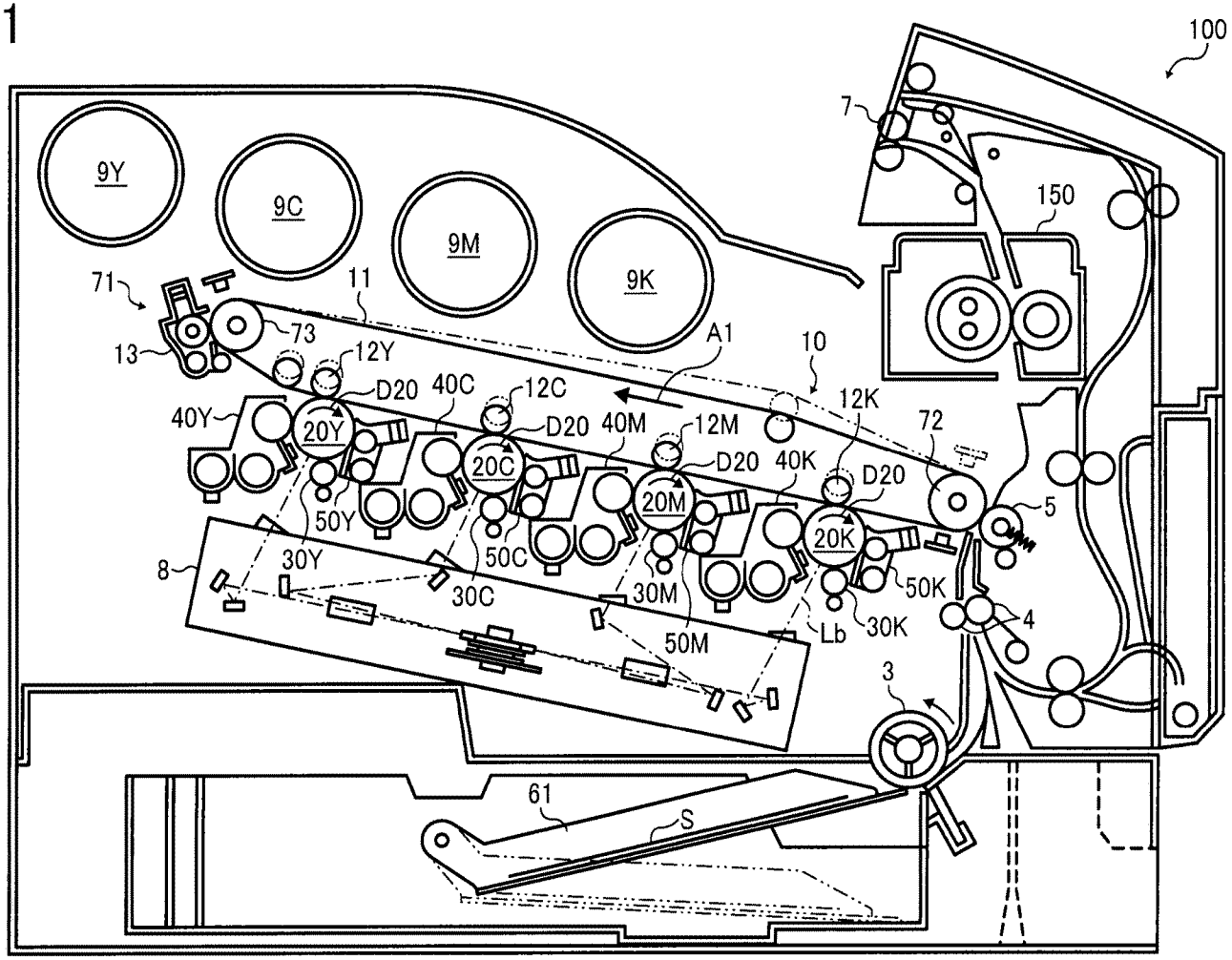
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

A description is provided of a construction and an operation of the image forming apparatus 100.

The image forming apparatus 100 is a color printer employing a tandem system in which a plurality of image forming devices for forming toner images in a plurality of colors, respectively, is aligned in a rotation direction of an intermediate transfer belt.

The image forming apparatus 100 includes four photoconductive drums 20Y, 20C, 20M, and 20K serving as image bearers that bear yellow, cyan, magenta, and black toner images in separation colors, respectively, that is, yellow, cyan, magenta, and black. The yellow, cyan, magenta, and black toner images formed on the photoconductive drums 20Y, 20C, 20M, and 20K as visible images, respectively, are primarily transferred successively onto an intermediate transfer belt 11 serving as an intermediate transferor disposed opposite the photoconductive drums 20Y, 20C, 20M, and 20K as the intermediate transfer belt 11 rotates in a rotation direction Al such that the yellow, cyan, magenta, and black toner images are superimposed on a same position on the intermediate transfer belt 11 in a primary transfer process. Thereafter, the yellow, cyan, magenta, and black toner images superimposed on the intermediate transfer belt 11 are secondarily transferred onto a sheet S serving as a recording medium collectively in a secondary transfer process. Each of the photoconductive drums 20Y, 20C, 20M, and 20K is surrounded by image forming components that form the yellow, cyan, magenta, and black toner images on the photoconductive drums 20Y, 20C, 20M, and 20K as the photoconductive drums 20Y, 20C, 20M, and 20K rotate clockwise in FIG. 1 in a rotation direction D20.

Taking the photoconductive drum 20K that forms the black toner image, the following describes a construction of components that form the black toner image.

The photoconductive drum 20K is surrounded by a charger 30K, a developing device 40K, a primary transfer roller 12K, and a cleaner 50K in this order in the rotation direction D20 of the photoconductive drum 20K. Similarly, the photoconductive drums 20Y, 20C, and 20M are surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. The charger 30K uniformly changes an outer circumferential surface of the photoconductive drum 20K. An optical writing device 8 optically writes an electrostatic latent image on the charged outer circumferential surface of the photoconductive drum 20K according to image data sent from an external device such as a client computer. The developing device 40K visualizes the electrostatic latent image as a black toner image.

As the intermediate transfer belt 11 rotates in the rotation direction Al, the yellow, cyan, magenta, and black toner images formed on the photoconductive drums 20Y, 20C, 20M, and 20K, respectively, are primarily transferred successively onto the intermediate transfer belt 11, thus being superimposed on the same position on the intermediate transfer belt 11 and formed into a color toner image. In the primary transfer process, the primary transfer rollers 12Y, 12C, 12M, and 12K disposed opposite the photoconductive drums 20Y, 20C, 20M, and 20K via the intermediate transfer belt 11, respectively, apply a primary transfer bias to the photoconductive drums 20Y, 20C, 20M, and 20K successively from the upstream photoconductive drum 20Y to the downstream photoconductive drum 20K in the rotation direction Al of the intermediate transfer belt 11. The photoconductive drums 20Y, 20C, 20M, and 20K are aligned in this order in the rotation direction Al of the intermediate transfer belt 11. The photoconductive drums 20Y, 20C, 20M, and 20K are located in four image forming stations that form the yellow, cyan, magenta, and black toner images, respectively.

The image forming apparatus 100 includes the four image forming stations that form the yellow, cyan, magenta, and black toner images, respectively, an intermediate transfer belt unit 10, a secondary transfer roller 5, an intermediate transfer belt cleaner 13, and the optical writing device 8. The intermediate transfer belt unit 10 is situated above and disposed opposite the photoconductive drums 20Y, 20C, 20M, and 20K. The intermediate transfer belt unit 10 incorporates the intermediate transfer belt 11 and the primary transfer rollers 12Y, 12C, 12M, and 12K. The secondary transfer roller 5 serves as a secondary transferor disposed opposite the intermediate transfer belt 11 and driven and rotated in accordance with rotation of the intermediate transfer belt 11. The intermediate transfer belt cleaner 13 is disposed opposite the intermediate transfer belt 11 to clean the intermediate transfer belt 11. The optical writing device 8 is situated below and disposed opposite the four image forming stations.

The optical writing device 8 includes a semiconductor laser serving as a light source, a coupling lens, an f0 lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K thereto, forming electrostatic latent images on the photoconductive drums 20Y, 20C, 20M, and 20K, respectively. FIG. 1 illustrates the light beam Lb irradiating the photoconductive drum 20K. Similarly, light beams irradiate the photoconductive drums 20Y, 20C, and 20M, respectively.

The image forming apparatus 100 further includes a sheet feeder 61 and a registration roller pair 4. The sheet feeder 61, disposed in a lower portion of the image forming apparatus 100, incorporates a paper tray that loads a plurality of sheets S to be conveyed to a secondary transfer nip formed between the intermediate transfer belt 11 and the secondary transfer roller 5. The registration roller pair 4 serving as a conveyor conveys the sheet S conveyed from the sheet feeder 61 to the secondary transfer nip formed between the intermediate transfer belt 11 and the secondary transfer roller 5 at a predetermined time when the yellow, cyan, magenta, and black toner images superimposed on the intermediate transfer belt 11 reach the secondary transfer nip. The image forming apparatus 100 further includes a sensor for detecting that a leading edge of the sheet S reaches the registration roller pair 4.

The secondary transfer roller 5 secondarily transfers the color toner image formed on the intermediate transfer belt 11 onto the sheet S as the sheet S is conveyed through the secondary transfer nip. The sheet S bearing the color toner image is conveyed to a fixing device 150 where the color toner image is fixed on the sheet S under heat and pressure. An output roller pair 7 ejects the sheet S bearing the fixed color toner image onto an output tray disposed atop the image forming apparatus 100. In an upper portion of the image forming apparatus 100 and below the output tray are toner bottles 9Y, 9C, 9M, and 9K containing fresh yellow, cyan, magenta, and black toners, respectively.

The intermediate transfer belt unit 10 includes a driving roller 72 and a driven roller 73 over which the intermediate transfer belt 11 is looped, in addition to the intermediate transfer belt 11 and the primary transfer rollers 12Y, 12C, 12M, and 12K. Since the driven roller 73 also serves as a tension applicator that applies tension to the intermediate transfer belt 11, a biasing member (e.g., a spring) biases the driven roller 73 against the intermediate transfer belt 11. The intermediate transfer belt unit 10, the secondary transfer roller 5, and the intermediate transfer belt cleaner 13 constitute a transfer device 71. The sheet feeder 61 includes a feed roller 3 that contacts an upper side of an uppermost sheet S of the plurality of sheets S loaded on the paper tray of the sheet feeder 61. As the feed roller 3 is driven and rotated counterclockwise in FIG. 1, the feed roller 3 feeds the uppermost sheet S to the registration roller pair 4.

The intermediate transfer belt cleaner 13 of the transfer device 71 includes a cleaning brush and a cleaning blade disposed opposite the intermediate transfer belt 11 to come into contact with the intermediate transfer belt 11. The cleaning brush and the cleaning blade scrape a foreign substance such as residual toner particles off the intermediate transfer belt 11, removing the foreign substance from the intermediate transfer belt 11 and thereby cleaning the intermediate transfer belt 11. The intermediate transfer belt cleaner 13 further includes a waste toner conveyer that conveys the residual toner particles removed from the intermediate transfer belt 11.

Figure 2:
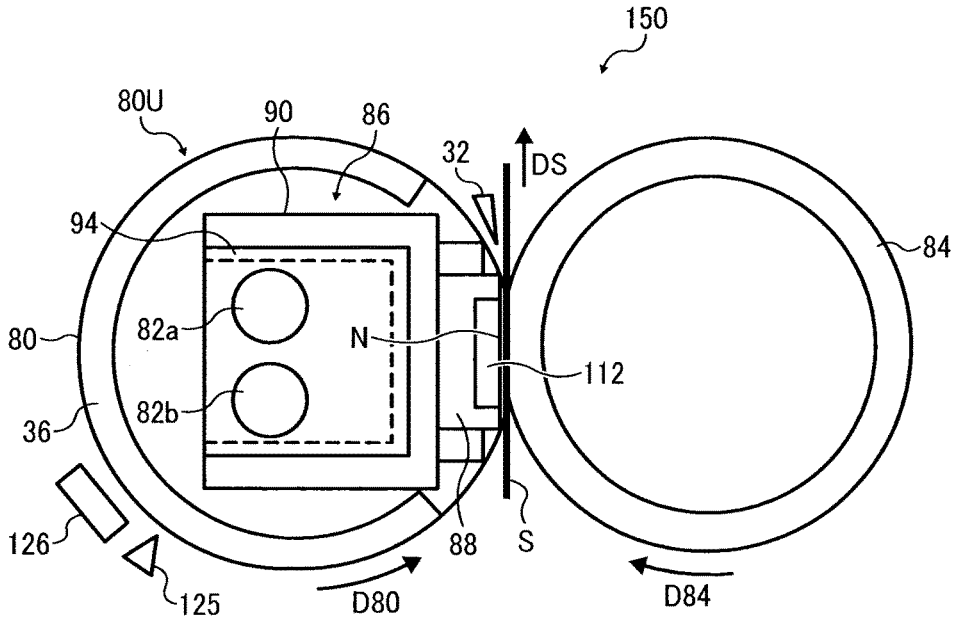
FIG. 2 is a schematic vertical cross-sectional view of a fixing device incorporated in the image forming apparatus illustrated in FIG. 1.

Referring to FIG. 2, a description is provided of a configuration of the fixing device 150 incorporated in the image forming apparatus 100 having the construction described above.

FIG. 2 is a schematic vertical cross-sectional view of the fixing device 150. As illustrated in FIG. 2, the fixing device 150 (e.g., a fuser or a fusing unit) includes a thin, flexible, endless fixing belt 80, serving as an endless belt or a fixing rotator, formed into a loop and rotatable in a rotation direction D80 and a pressure roller 84 serving as a pressure rotator disposed opposite the fixing belt 80 and rotatable in a rotation direction D84. Inside the loop formed by the fixing belt 80 is a nip formation assembly 86 (e.g., a nip formation unit) that forms a fixing nip N between the fixing belt 80 and the pressure roller 84, through which a sheet S serving as a recording medium is conveyed.

A detailed description is now given of a construction of the nip formation assembly 86.

The nip formation assembly 86 includes a nip formation pad 88, a lateral end heater 112, and a stay 90. The nip formation pad 88, disposed inside the loop formed by the fixing belt 80 and disposed opposite the pressure roller 84, presses against the pressure roller 84 via the fixing belt 80 to form the fixing nip N between the fixing belt 80 and the pressure roller 84. The lateral end heater 112 is mounted on each lateral end of the nip formation pad 88 in a longitudinal direction thereof parallel to an axial direction of the fixing belt 80. The stay 90 supports the nip formation pad 88 against pressure from the pressure roller 84.

The stay 90 has a box shape with an opening opposite the fixing nip N. Halogen heaters 82*a* and 82*b* serving as a primary heater are disposed inside the box of the stay 90. The halogen heaters 82*a* and 82*b* emit light that irradiates an inner circumferential surface of the fixing belt 80 directly through the opening of the stay 90, heating the fixing belt 80 with radiant heat. A platy reflector 94 is mounted on an interior surface of the stay 90 to reflect light radiated from the halogen heaters 82*a* and 82*b* toward the fixing belt 80 so as to improve heating efficiency of the halogen heaters 82*a* and 82*b* to heat the fixing belt 80. The reflector 94 prevents light and heat from the halogen heaters 82*a* and 82*b* from heating the stay 90, suppressing waste of energy. Alternatively, instead of the reflector 94, the interior surface of the stay 90 may be treated with insulation or mirror finish to reflect light radiated from the halogen heaters 82*a* and 82*b* toward the fixing belt 80.

A detailed description is now given of a construction of the pressure roller 84.

Figure 3:
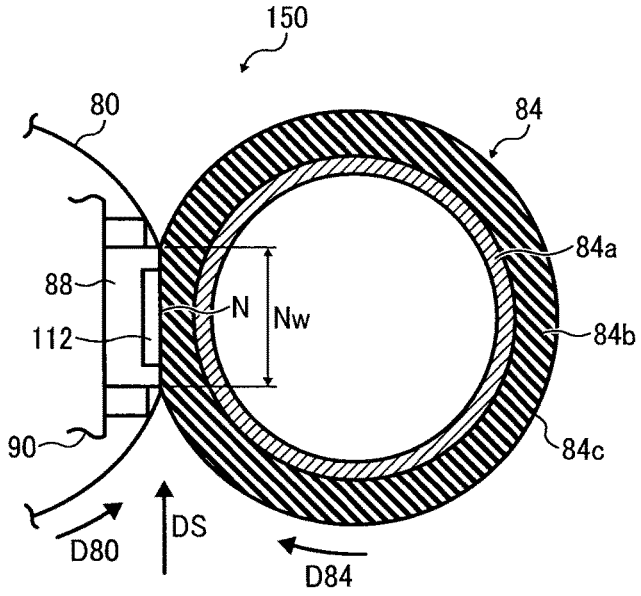
FIG. 3 is a partial vertical cross-sectional view of the fixing device illustrated in FIG. 2.

FIG. 3 is a partial vertical cross-sectional view of the fixing device 150. As illustrated in FIG. 3, the pressure roller 84 is constructed of a hollow metal roller 84*a*, an elastic layer 84*b* coating an outer circumferential surface of the metal roller 84*a* and being made of silicone rubber, and a release layer 84*c* coating an outer circumferential surface of the elastic layer 84*b*. The release layer 84*c*, having a layer thickness in a range of from 5 micrometers to 50 micrometers, is made of perfluoroalkoxy fluoro resin (PFA) or polytetrafluoroethylene (PTFE) to facilitate separation of the sheet S from the pressure roller 84. As a driving force generated by a driver (e.g., a motor) situated inside the image forming apparatus 100 depicted in FIG. 1 is transmitted to the pressure roller 84 through a gear train, the pressure roller 84 rotates in the rotation direction D84. Alternatively, the driver may also be connected to the fixing belt 80 to drive and rotate the fixing belt 80. A spring or the like biases the pressure roller 84 against the fixing belt 80. As the elastic layer 84*b* of the pressure roller 84 is pressed and deformed, the pressure roller 84 produces the fixing nip N having a predetermined length Nw in a sheet conveyance direction DS. Alternatively, the pressure roller 84 may be a solid roller. However, a hollow roller has a decreased thermal capacity. Further, a heater or a heat source such as a halogen heater may be disposed inside the pressure roller 84. The elastic layer 84*b* may be made of solid rubber. Alternatively, if no heater is situated inside the pressure roller 84, the elastic layer 84*b* may be made of sponge rubber. The sponge rubber is more preferable than the solid rubber because the sponge rubber has an increased insulation that draws less heat from the fixing belt 80.

A detailed description is now given of a construction of the fixing belt 80.

The fixing belt 80 is an endless belt or film having a layer thickness in a range of from 30 micrometers to 50 micrometers and made of metal such as nickel and SUS stainless steel or resin such as polyimide. The fixing belt 80 is constructed of a base layer and a release layer. The release layer constituting an outer surface layer is made of PFA, PTFE, or the like to facilitate separation of toner of a toner image on the sheet S from the fixing belt 80, thus preventing the toner of the toner image from adhering to the fixing belt 80. Optionally, an elastic layer made of silicone rubber or the like may be sandwiched between the base layer and the release layer. If the fixing belt 80 does not incorporate the elastic layer, the fixing belt 80 has a decreased thermal capacity that improves fixing property of being heated quickly to a desired fixing temperature at which the toner image is fixed on the sheet S. However, as the pressure roller 84 and the fixing belt 80 sandwich and press the unfixed toner image on the sheet S passing through the fixing nip N, slight surface asperities of the fixing belt 80 may be transferred onto the toner image on the sheet S, resulting in variation in gloss of the solid toner image on the sheet S.

To address this circumstance, the elastic layer made of silicone rubber has a thickness not smaller than 100 micrometers. As the elastic layer deforms, the elastic layer absorbs slight surface asperities of the fixing belt 80, suppressing variation in gloss of the toner image on the sheet S. As illustrated in FIG. 2, as the pressure roller 84 rotates in the rotation direction D84, the fixing belt 80 rotates in the rotation direction D80 in accordance with rotation of the pressure roller 84 by friction between the pressure roller 84 and the fixing belt 80. At the fixing nip N, the fixing belt 80 rotates as the fixing belt 80 is sandwiched between the pressure roller 84 and the nip formation pad 88; at a circumferential span of the fixing belt 80 other than the fixing nip N, the fixing belt 80 rotates while the fixing belt 80 is supported at each lateral end in the axial direction thereof to retain a tubular shape. Thus, the fixing belt 80 is retained circular in cross-section stably. As illustrated in FIG. 2, a separator 32 is disposed downstream from the fixing nip N in the sheet conveyance direction DS to separate the sheet S from the fixing belt 80.

According to this exemplary embodiment, as illustrated in FIGS. 2 and 3, the fixing nip N is planar. Alternatively, the fixing nip N may define a curve projecting toward the fixing belt 80 to produce a recess in the fixing belt 80 in cross-section or other shapes. If the fixing nip N defines the recess in the fixing belt 80, the recessed fixing nip N directs the leading edge of the sheet S toward the pressure roller 84 as the sheet S is ejected from the fixing nip N, facilitating separation of the sheet S from the fixing belt 80 and suppressing jamming of the sheet S. In this case, a nip formation face of the nip formation pad 88 is contoured into the recess. Similarly, a fixing nip side face of the lateral end heater 112, serving as a secondary heater coupled with the nip formation pad 88, may be contoured along the recessed nip formation face of the nip formation pad 88.

A detailed description is now given of a configuration of the stay 90.

The stay 90 supports the nip formation pad 88 against pressure from the pressure roller 84 to prevent bending of the nip formation pad 88 and produce the even length Nw of the fixing nip N in the sheet conveyance direction DS throughout the entire width of the fixing belt 80 in the axial direction thereof as illustrated in FIG. 3. As illustrated in FIG. 2, according to this exemplary embodiment, the pressure roller 84 is pressed against the fixing belt 80 to form the fixing nip N. Alternatively, the nip formation assembly 86 may be pressed against the pressure roller 84 to form the fixing nip N. The stay 90 has a mechanical strength great enough to support the nip formation pad 88 to prevent bending of the nip formation pad 88. The stay 90 is made of metal such as stainless steel and iron, metallic oxide such as ceramics, or the like.

The fixing belt 80 and the components disposed inside the loop formed by the fixing belt 80, that is, the halogen heaters 82*a* and 82*b*, the nip formation pad 88, the lateral end heater 112, the stay 90, and the reflector 94, may constitute a belt unit 80U separably coupled with the pressure roller 84.

Figure 4:
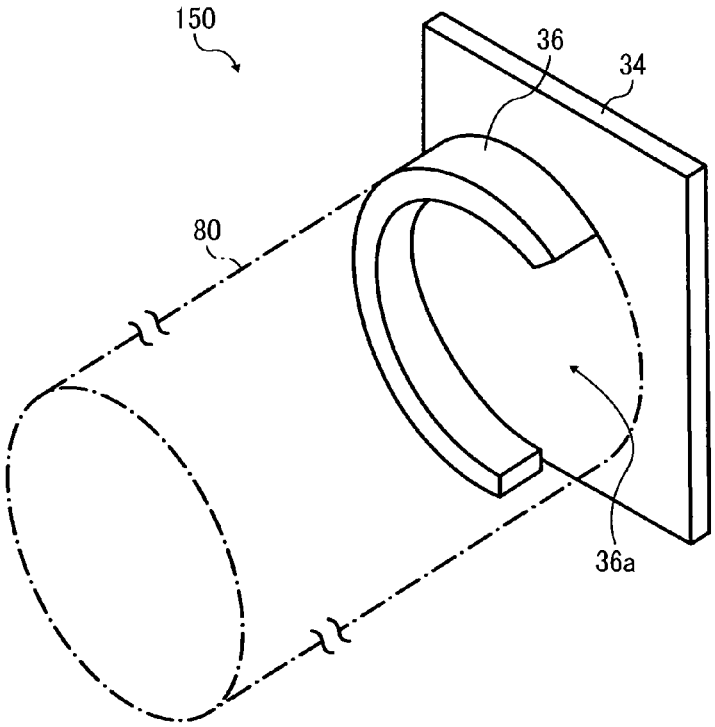
FIG. 4 is a partial perspective view of the fixing device illustrated in FIG. 2.

FIG. 4 is a partial perspective view of the fixing device 150. As illustrated in FIG. 4, both lateral ends of the fixing belt 80 in the axial direction thereof are rotatably supported by flanges 36, respectively. Each of the flanges 36 serves as a support projecting from a side plate 34 in the axial direction of the fixing belt 80. Although FIG. 4 illustrates the flange 36 and the side plate 34 situated at one lateral end of the fixing belt 80 in the axial direction thereof, the flange 36 and the side plate 34 are also situated at another lateral end of the fixing belt 80 in the axial direction thereof. The flange 36 that guides each lateral end of the fixing belt 80 in the axial direction thereof has an outer diameter substantially equivalent to an inner diameter of the fixing belt 80. The flange 36 projects inboard from a lateral edge of the fixing belt 80 by a length in a range of from 5 mm to 10 mm in the axial direction of the fixing belt 80. The flanges 36 guide the fixing belt 80 even when the fixing belt 80 rotates, retaining the fixing belt 80 to be circular in cross-section. The flange 36 includes a slit 36*a* disposed opposite the fixing nip N to place the nip formation assembly 86 at a predetermined position. The stay 90 depicted in FIG. 2 has a width that spans the entire width of the fixing belt 80 in the axial direction thereof. Both lateral ends of the stay 90 in the axial direction of the fixing belt 80 are fixedly mounted on or secured to the side plates 34, respectively, thus being supported and positioned by the side plates 34.

A detailed description is now given of a configuration of the halogen heaters 82*a* and 82*b* and the lateral end heater 112.

Figure 5:
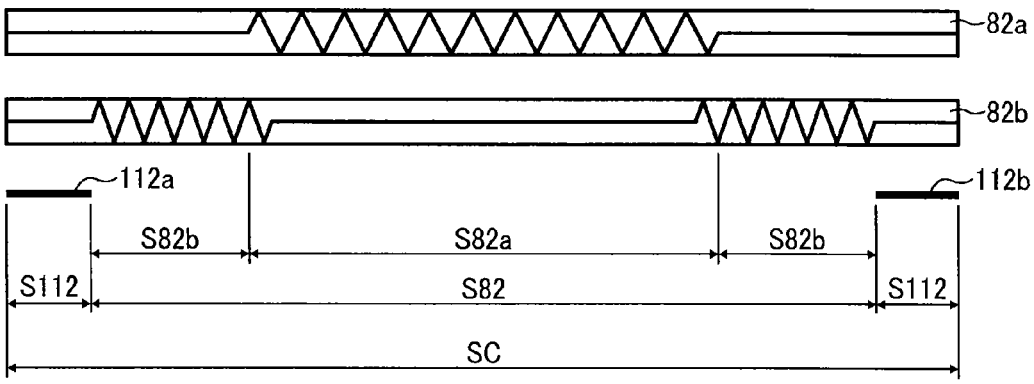
FIG. 5 is a plan view of halogen heaters and lateral end heaters incorporated in the fixing device illustrated in FIG. 2.

FIG. 5 is a plan view of the halogen heaters 82*a* and 82*b* and the lateral end heater 112 constructed of lateral end heaters 112*a* and 112*b*, illustrating a light distribution of the halogen heaters 82*a* and 82*b* and a positional relation between the halogen heaters 82*a* and 82*b* and the lateral end heaters 112*a* and 112*b*. FIG. 5 illustrates a primary heating span S82 in the axial direction of the fixing belt 80 where the halogen heaters 82*a* and 82*b* heat the fixing belt 80. The primary heating span S82 is equivalent to a width of an A3 size sheet in portrait orientation in the axial direction of the fixing belt 80. FIG. 5 further illustrates a combined heating span SC in the axial direction of the fixing belt 80 where the halogen heaters 82*a* and 82*b* and the lateral end heaters 112*a* and 112*b* heat the fixing belt 80. The combined heating span SC is equivalent to a width of an A3 extension size sheet and a 13-inch sheet in portrait orientation in the axial direction of the fixing belt 80.

As illustrated in FIG. 5, the halogen heater 82*a* serves as a primary heater having a dense light distribution in a primary heating span S82*a* disposed opposite a center span of the fixing belt 80 in the axial direction thereof where a small sheet S having a decreased width in the axial direction of the fixing belt 80 is conveyed over the fixing belt 80. The primary heating span S82*a* is equivalent to a width of an A4 size sheet in portrait orientation in the axial direction of the fixing belt 80. The halogen heater 82*b* serves as a primary heater having a dense light distribution in a primary heating span S82*b* disposed opposite each lateral end span of the fixing belt 80 in the axial direction thereof where a medium sheet S having a medium width (e.g., an A3 size sheet) in the axial direction of the fixing belt 80 is conveyed over the fixing belt 80. As the small sheet S is conveyed over the fixing belt 80, the halogen heater 82*a* is powered on and the halogen heater 82*b* is not powered on, thus preventing each lateral end span, that is, a non-conveyance span, of the fixing belt 80 in the axial direction thereof where the small sheet S is not conveyed from being heated unnecessarily.

The width of the A3 size sheet in portrait orientation and the width of the A4 size sheet in landscape orientation are smaller than the width of the A3 extension size sheet in portrait orientation (e.g., 329 mm) and the width of the 13-inch sheet in portrait orientation (e.g., 330 mm) by a differential in a range of from 32 mm to 33 mm, respectively. Accordingly, if the fixing device 150 is configured to heat each lateral end span of the fixing belt 80 in the axial direction thereof, that is, if the fixing device 150 is configured to heat a half of the differential in the range of from 32 mm to 33 mm, that is, a span in a range of from 16.0 mm to 16.5 mm, the maximum width of sheets S available in the fixing device 150 increases from the width of the A3 size sheet equivalent to the primary heating span S82 to the width of the A3 extension size sheet or the like equivalent to the combined heating span SC as illustrated in FIG. 5. In other words, if the fixing device 150 is configured to heat each outboard span of the fixing belt 80 disposed opposite each outboard span of the halogen heater 82*b* that is outboard from the primary heating span S82*b* in the axial direction of the fixing belt 80 and does not have the dense light distribution, the large sheet S (e.g., the A3 extension size sheet) is available in the fixing device 150. Accordingly, the fixing device 150 includes the lateral end heater 112 constructed of downsized heaters, that is, the lateral end heaters 112*a* and 112*b* serving as a secondary heater or a lateral end heater, each of which has a decreased width of about 20 mm in the axial direction of the fixing belt 80.

As the large sheet S (e.g., the A3 extension size sheet and the 13-inch sheet) is conveyed through the fixing nip N, the halogen heaters 82*a* and 82*b* and the lateral end heaters 112*a* and 112*b* are energized. Conversely, as the small sheet S (e.g., a sheet not greater than the A3 size sheet) is conveyed through the fixing nip N, the halogen heaters 82*a* and 82*b* are energized or the halogen heater 82*a* is energized. Hence, the lateral end heaters 112*a* and 112*b* are not energized. If the halogen heater 82*b* is configured to define an increased heating span, that is, the combined heating span SC, to heat the large sheet S such as the A3 extension size sheet, the halogen heater 82*b* may heat the outboard span of the fixing belt 80 unnecessarily while the large sheet S is not conveyed through the fixing nip N, wasting energy. To address this circumstance, the fixing device 150 according to this exemplary embodiment incorporates a simple mechanism in addition to the halogen heaters 82*a* and 82*b*, that is, the lateral end heaters 112*a* and 112*b* being disposed opposite both lateral end heating spans, that is, both secondary heating spans S112, in the axial direction of the fixing belt 80 or disposed in proximity to both lateral ends of the fixing belt 80 in the axial direction thereof, respectively.

A description is provided of a configuration of a first comparative fixing device incorporating a fixing roller.

The first comparative fixing device is requested to fix a toner image on sheets of various sizes. To address this request, if the first comparative fixing device employs an elongated heater to correspond to a width of a large sheet, the elongated heater may unnecessarily heat each lateral end span in an axial direction of the fixing roller, that is, a non-conveyance span, of the fixing roller where a small sheet is not conveyed, thus overheating the non-conveyance span of the fixing roller. To address this circumstance, the first comparative fixing device may convey the sheet at a decreased speed, degrading productivity. Alternatively, the first comparative fixing device may include a first halogen heater and a second halogen heater situated inside the fixing roller. The first halogen heater has a dense light distribution in a center span of the first halogen heater in the axial direction of the fixing roller. Conversely, the second halogen heater has a dense light distribution in each lateral end span of the second halogen heater in the axial direction of the fixing roller. When the small sheet is conveyed through the first comparative fixing device, the first halogen heater is energized to heat a center span of the fixing roller in the axial direction thereof where the small sheet is conveyed.

On the other hand, the first comparative fixing device is requested to fix a toner image on large sheets greater than the A3 size sheet such as the A3 extension size sheet and the 13-inch sheet although the large sheets are used infrequently. To address this circumstance, the first comparative fixing device may incorporate a separate halogen heater having a light distribution corresponding to those large sheets. However, it may be difficult to place the separate halogen heater inside the downsized fixing roller having a restricted diameter.

A description is provided of a configuration of a second comparative fixing device configured to address the above-described circumstances of the first comparative fixing device.

The second comparative fixing device includes a thin, flexible endless belt to be heated quickly to a fixing temperature at which a toner image is fixed on a sheet and a nip formation unit situated inside a loop formed by the endless belt. The nip formation unit presses against a pressure roller via the endless belt to form a fixing nip between the endless belt and the pressure roller. A plurality of halogen heaters having different light distributions, respectively, is situated inside the loop formed by the endless belt. A plurality of lateral end heaters is disposed opposite both lateral end spans of the endless belt in an axial direction thereof, respectively, and disposed upstream from the fixing nip in a rotation direction of the endless belt so as to heat an increased heating span of the endless belt corresponding to the width of the large sheet in the axial direction of the endless belt. The lateral end heaters contact an inner circumferential surface or an outer circumferential surface of the endless belt. The lateral end heaters heat the increased heating span of the endless belt corresponding to the width of the large sheet in the axial direction of the endless belt with a simple construction not incorporating an extra halogen heater directed to the large sheet.

Additionally, the second comparative fixing device is requested to save energy. To address this request, a preheating mode of the halogen heaters in which the halogen heaters are ready to heat the endless belt before the second comparative fixing device receives a print job is barely available to reduce power consumption. In order to shorten a resuming time from an energy saver mode, a thin endless belt having a decreased thermal capacity may be employed. However, the thin endless belt may decrease an amount of heat conducted in the axial direction of the endless belt per unit time. For example, while a sheet is conveyed over a conveyance span of the endless belt, the sheet does not draw heat from a non-conveyance span of the endless belt where the sheet is not conveyed over the endless belt. Accordingly, the non-conveyance span of the endless belt may suffer from overheating. Further, the thin endless belt reduces the amount of heat conducted between the non-conveyance span and the conveyance span. Consequently, the temperature of the endless belt may vary in the axial direction of the endless belt, causing overheating of the non-conveyance span of the endless belt. To address this circumstance, the sheet may be conveyed at a decreased speed and the halogen heaters may be supplied with decreased power to prevent overheating of the endless belt, degrading satisfaction of a user.

To address this circumstance, a plurality of halogen heaters serving as a primary heater has a primary heating span disposed opposite a sheet not greater than the large sheet and a plurality of laminated heaters serving as a secondary heater has a secondary heating span disposed opposite each lateral end of the large sheet in the axial direction of the endless belt. The halogen heater has a heating property in which the halogen heater attains a decreased heat output at each lateral end of the halogen heater in the axial direction of the endless belt. Conversely, the laminated heater does not have such heating property. Accordingly, under combination of the halogen heaters and the laminated heaters, the halogen heater and the laminated heater produce an overlapping heating span where the primary heating span of the halogen heater overlaps the secondary heating span of the laminated heater in the axial direction of the endless belt. The endless belt may be conducted with an increased amount of heat in the overlapping heating span, varying the amount of heat conducted from the halogen heater and the laminated heater to the endless belt in the axial direction thereof. Consequently, the second comparative fixing device may suffer from fixing failure such as cold offset and hot offset and degradation in quality of a toner image fixed on a sheet such as variation in gloss of the toner image.

A detailed description is now given of a configuration of the plurality of halogen heaters incorporated in the second comparative fixing device.

The plurality of halogen heaters includes a center halogen heater having a dense light distribution in a center span of the center halogen heater in the axial direction of the endless belt and a lateral end halogen heater having a dense light distribution in each lateral end span of the lateral end halogen heater in the axial direction of the endless belt. As a small sheet is conveyed through the second comparative fixing device, the center halogen heater is powered on. As a medium sheet is conveyed through the second comparative fixing device, the lateral end halogen heater is powered on together with the center halogen heater. The center halogen heater and the lateral end halogen heater are powered on and off properly to heat sheets of various sizes.

Taking the sizes of the sheets and the frequency with which the sheets are conveyed, sheets up to the A3 size sheet are used frequently. The A3 size sheet is conveyed through the second comparative fixing device in portrait orientation. The A4 size sheet and a letter (LT) size sheet that are used frequently are generally conveyed in landscape orientation to enhance productivity. To address this circumstance, the center halogen heater and the lateral end halogen heater produce a heating span of about 300 mm in the axial direction of the endless belt that is great enough to heat 99 percent or more of the sizes of sheets. On the other hand, the second comparative fixing device is requested to fix a toner image on large sheets greater than the A3 size sheet in the axial direction of the endless belt such as the A3 extension size sheet and the 13-inch sheet although the large sheets are used infrequently.

If the plurality of halogen heaters is used as the center halogen heater and the lateral end halogen heater, respectively, the plurality of halogen heaters used to heat the small sheet is situated inside the loop formed by the endless belt or the fixing roller having a diameter of about 30 mm. Accordingly, the number of the halogen heaters is limited. To address this circumstance, the lateral end halogen heater having the dense light distribution in the lateral end span of the lateral end halogen heater may be elongated to span a width of the large sheet greater than the width of the A3 size sheet in the axial direction of the endless belt. As described above, the center halogen heater and the lateral end halogen heater heat the heating span of about 300 mm of the endless belt in the axial direction thereof frequently. However, if the elongated lateral end halogen heater is employed, the elongated lateral end halogen heater may heat an elongated heating span of about 330 mm of the endless belt in the axial direction thereof, wasting energy used to heat a differential between the heating span of about 300 mm and the elongated heating span of about 330 mm. When the A3 size sheet in portrait orientation or the A4 size sheet in landscape orientation is conveyed through the second comparative fixing device, each lateral end of the elongated heating span of the endless belt in the axial direction thereof that corresponds to the differential between the heating span of about 300 mm and the elongated heating span of about 330 mm may overheat. In order to cool the overheated lateral end of the endless belt, productivity defined by a conveyance speed of the sheets may be degraded or a fan may be installed. If a reflection plate is interposed between the lateral end halogen heater and the endless belt, each lateral end of the lateral end halogen heater in the axial direction of the endless belt may overheat. To address those circumstances, the second comparative fixing device has the configuration described above.

A description is provided of securing of the lateral end heaters 112*a* and 112*b* to the nip formation pad 88 and securing of the nip formation pad 88 to the stay 90.

Figure 6:
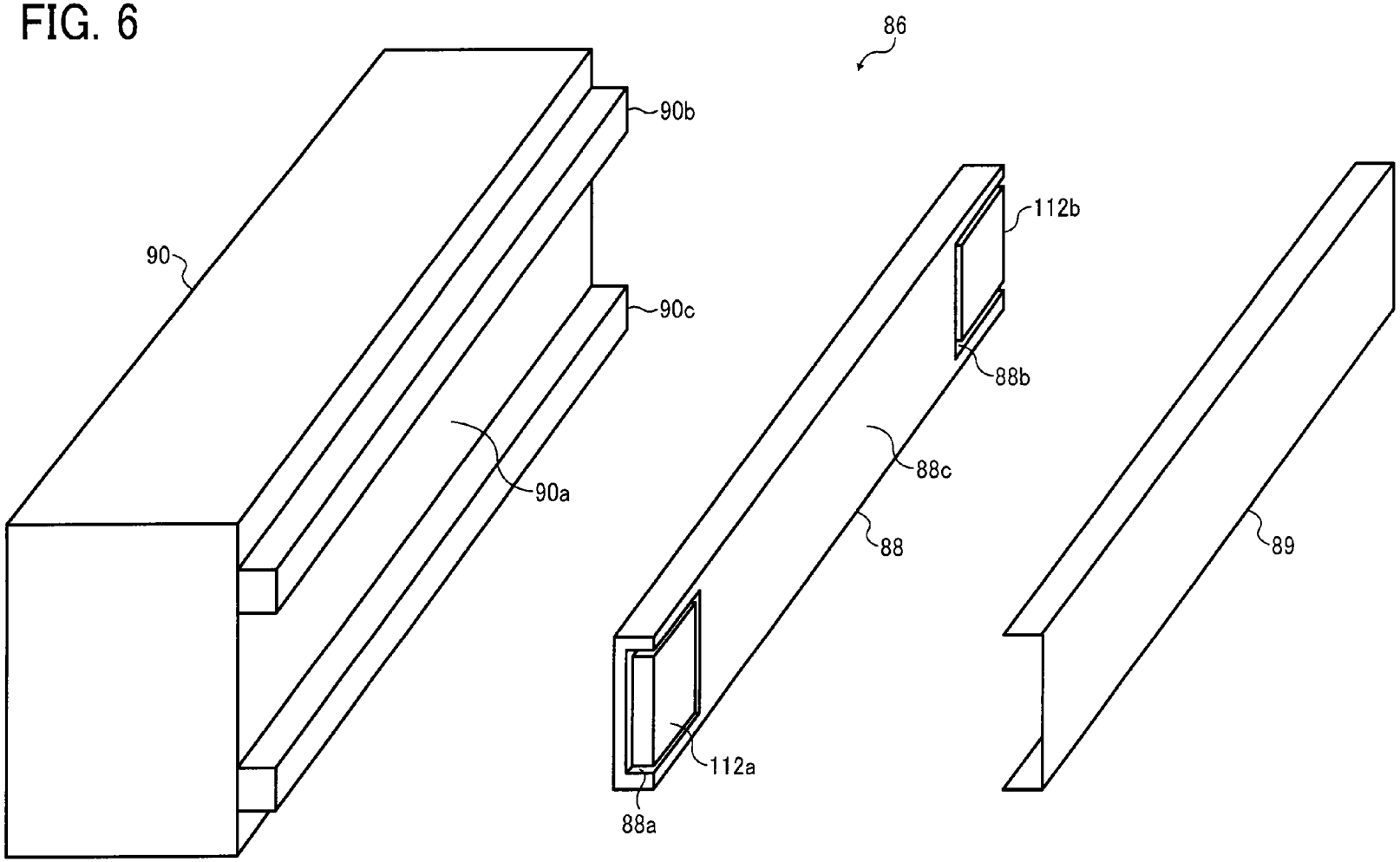
FIG. 6 is an exploded perspective view of a nip formation assembly incorporated in the fixing device illustrated in FIG. 2.

FIG. 6 is an exploded perspective view of the nip formation assembly 86. As illustrated in FIG. 6, a side face 90*a* of the stay 90 that faces the pressure roller 84 mounts two ridges 90*b* and 90*c* extending in the axial direction of the fixing belt 80. The rectangular nip formation pad 88 is sandwiched and positioned between the two ridges 90*b* and 90*c* in the sheet conveyance direction DS and is secured to the side face 90*a* with an adhesive or the like. Thus, the side face 90*a* and the two ridges 90*b* and 90*c* accommodate the nip formation pad 88. Two recesses 88*a* and 88*b* that define a difference in thickness of the nip formation pad 88 are disposed at both lateral ends of the nip formation pad 88 in the longitudinal direction thereof. The lateral end heaters 112*a* and 112*b* are attached to the recesses 88*a* and 88*b* with an adhesive or the like or secured to the recesses 88*a* and 88*b*, respectively, thus being accommodated by the recesses 88*a* and 88*b*. The nip formation pad 88 includes a nip formation face 88*c* that faces the pressure roller 84.

A metal plate 89 serving as a thermal conductor or a thermal conduction aid is sandwiched between the nip formation pad 88 and the fixing belt 80 at the fixing nip N. The metal plate 89 covers the nip formation pad 88. The metal plate 89 is made of a material that conducts heat from the lateral end heaters 112*a* and 112*b* to the fixing belt 80 quickly to reduce uneven temperature of the fixing belt 80 in the axial direction thereof, for example, a material having an increased thermal conductivity such as copper, aluminum, and silver. It is preferable that the metal plate 89 is made of copper in a comprehensive view of manufacturing costs, availability, thermal conductivity, and processing. The inner circumferential surface of the fixing belt 80 slides over the metal plate 89 via a slide sheet (e.g., a low-friction sheet). The slide sheet is applied with a lubricant such as fluorine grease and silicone oil to decrease a slide torque of the fixing belt 80. Alternatively, the metal plate 89 may contact the inner circumferential surface of the fixing belt 80 directly, not via the slide sheet. In this case, the metal plate 89 may be coated with resin or the like to decrease friction between the metal plate 89 and the fixing belt 80.

As illustrated in FIG. 6, the nip formation assembly 86 incorporates the metal plate 89. Alternatively, the nip formation assembly 86 may not incorporate the metal plate 89 to decrease the thermal capacity of the fixing device 150 so as to shorten a warm-up time taken to warm up the fixing belt 80 to a predetermined temperature and reduce power consumption. In this case, the fixing belt 80 slides over the nip formation pad 88. Like in the nip formation assembly 86 incorporating the metal plate 89, the slide sheet may be sandwiched between the fixing belt 80 and the nip formation pad 88 or the nip formation pad 88 may be treated with coating without the slide sheet sandwiched between the fixing belt 80 and the nip formation pad 88.

Figure 7B:
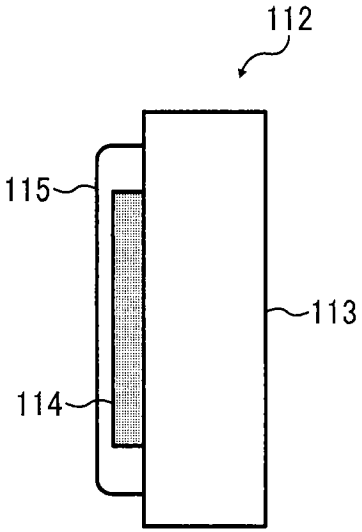
FIG. 7B is a side view of the lateral end heater illustrated in FIG. 7A.
Figure 7A:
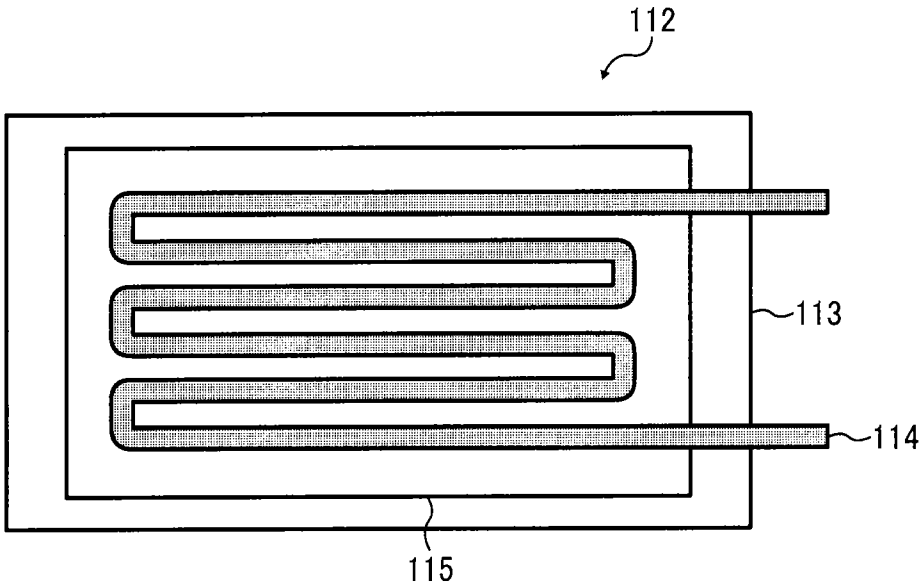
FIG. 7A is a plan view of a lateral end heater according to a first exemplary embodiment of the present disclosure that is incorporated in the nip formation assembly illustrated in FIG. 6.

Referring to FIGS. 7A and 7B, a description is provided of a configuration of the lateral end heater 112 according to a first exemplary embodiment.

FIG. 7A is a plan view of the lateral end heater 112. FIG. 7B is a side view of the lateral end heater 112. FIGS. 7A and 7B illustrate the lateral end heater 112 representing the lateral end heaters 112*a* and 112*b* depicted in FIG. 6. As illustrated in FIG. 7A, the lateral end heater 112 includes a ceramic base 113, a resistive heat generator 114 mounted on the ceramic base 113, and an insulative layer 115 mounted on the resistive heat generator 114. The ceramic base 113 has an outer size defined by a vertical length of about 10 mm and a horizontal length of about 20 mm in FIG. 7A. The insulative layer 115 is a thin glass layer. Since the resistive heat generator 114 is not disposed in an outer marginal portion on the ceramic base 113, an amount of heat generated in the outer marginal portion on the ceramic base 113 is smaller than an amount of heat generated in a center portion on the ceramic base 113. Each of the recesses 88*a* and 88*b* depicted in FIG. 6 contacts the outer marginal portion on the ceramic base 113 to prevent heat dissipation from the lateral end heater 112. Each of the recesses 88*a* and 88*b* contacts a first face of the lateral end heater 112 that mounts the ceramic base 113 or a second face of the lateral end heater 112 that mounts the insulative layer 115. If each of the recesses 88*a* and 88*b* contacts the second face of the lateral end heater 112 that mounts the insulative layer 115 constituting the thin glass layer, heat is conducted from the lateral end heater 112 to the metal plate 89 quickly, thus heating the fixing belt 80 effectively. In FIG. 7A, a left side of the lateral end heater 112 where a circuit of the resistive heat generator 114 is turned is directed to a center of the fixing belt 80 in the axial direction. Conversely, a right side of the lateral end heater 112 where the resistive heat generator 114 is supplied with power is directed to the lateral edge of the fixing belt 80 in the axial direction thereof.

A description is provided of a relation between the lateral end heaters 112*a* and 112*b* and the nip formation pad 88.

Figure 8A:
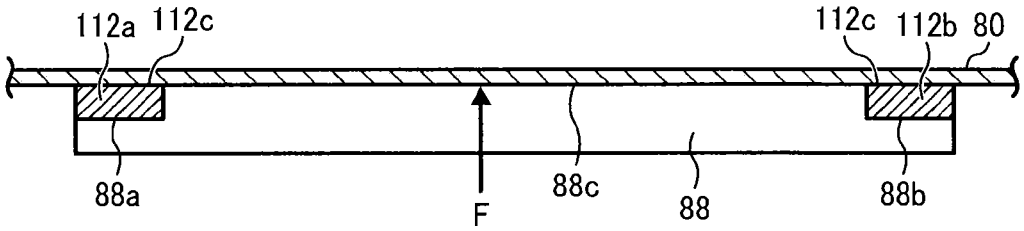
FIG. 8A is a cross-sectional view of a nip formation pad and the lateral end heaters incorporated in the nip formation assembly depicted in FIG. 6, illustrating recesses of the nip formation pad.

FIG. 8A is a cross-sectional view of the fixing belt 80, the nip formation pad 88, and the lateral end heaters 112*a* and 112*b*. As illustrated in FIG. 8A, each of the lateral end heaters 112*a* and 112*b* includes a fixing belt side face 112*c* contacting the inner circumferential surface of the fixing belt 80. The fixing belt side face 112*c* of the respective lateral end heaters 112*a* and 112*b* is leveled with the nip formation face 88*c* of the nip formation pad 88 in a pressurization direction F (e.g., a direction of a reaction force against pressure from the pressure roller 84) in which the nip formation pad 88 presses against the inner circumferential surface of the fixing belt 80. In other words, the fixing belt side face 112*c* contacting the inner circumferential surface of the fixing belt 80 defines an extension of the nip formation face 88*c* in the longitudinal direction of the nip formation pad 88. According to this exemplary embodiment, the lateral end heaters 112*a* and 112*b* are coupled with the nip formation pad 88 to form the fixing nip N. Hence, the lateral end heaters 112*a* and 112*b* are situated inside a limited space inside the loop formed by the fixing belt 80, saving space.

The fixing belt side face 112*c* of the respective lateral end heaters 112*a* and 112*b* that contacts the inner circumferential surface of the fixing belt 80 is leveled with the nip formation face 88*c* of the nip formation pad 88 in the pressurization direction F to define an identical plane. Accordingly, the pressure roller 84 is pressed against the lateral end heaters 112*a* and 112*b* via the fixing belt 80 with sufficient pressure. Consequently, the fixing belt 80 rotates in a state in which the fixing belt 80 is pressed against the lateral end heaters 112*a* and 112*b*, improving conduction of heat from the lateral end heaters 112*a* and 112*b* to the fixing belt 80 and thereby retaining improved heating efficiency of the lateral end heaters 112*a* and 112*b*. Since the lateral end heaters 112*a* and 112*b* are situated within the fixing nip N in the axial direction of the fixing belt 80 to heat the fixing belt 80, the lateral end heaters 112*a* and 112*b* do not heat a portion of the fixing belt 80 that is outboard from the fixing nip N in the axial direction of the fixing belt 80, preventing residual toner failed to be fixed on the sheet S and therefore remaining on the fixing belt 80 from being melted again and transferred onto the sheet S. The pressure roller 84 also serves as a biasing member that presses the fixing belt 80 against the lateral end heaters 112*a* and 112*b* to adhere the fixing belt 80 to the lateral end heaters 112*a* and 112*b* via the metal plate 89 so as to enhance conduction of heat from the lateral end heaters 112*a* and 112*b* to the fixing belt 80. Accordingly, a mechanism that presses the lateral end heaters 112*a* and 112*b* against the fixing belt 80 is not needed, simplifying the fixing device 150. In other words, pressure used to form the fixing nip N is also used to press the fixing belt 80 against the lateral end heaters 112*a* and 112*b*, improving conduction of heat from the lateral end heaters 112*a* and 112*b* to the fixing belt 80 without degrading rotation of the fixing belt 80.

Figure 8B:
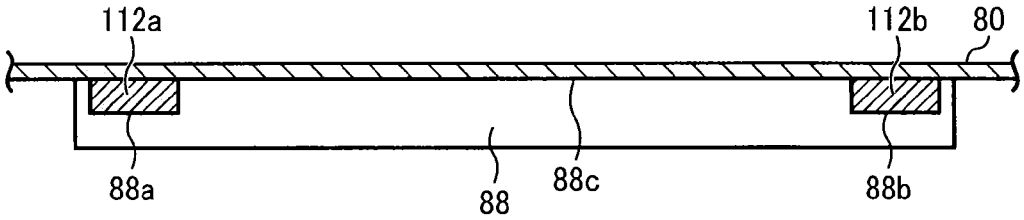
FIG. 8B is a cross-sectional view of the nip formation pad and the lateral end heaters depicted in FIG. 8A, illustrating closed recesses as a first variation of the recesses illustrated in FIG. 8A.

As illustrated in FIG. 6, each of the recesses 88*a* and 88*b* is open at each lateral edge of the nip formation pad 88 in the longitudinal direction thereof. Alternatively, each of the recesses 88*a* and 88*b* may be closed and formed in a box defined by a bottom and four walls as illustrated in FIG. 8B. FIG. 8B is a cross-sectional view of the fixing belt 80, the nip formation pad 88, and the lateral end heaters 112*a* and 112*b* illustrating the closed recesses 88*a* and 88*b* as a variation of the recesses 88*a* and 88*b* illustrated in FIG. 8A. Alternatively, each of the recesses 88*a* and 88*b* may be closed at both ends in the axial direction of the fixing belt 80 and open at both ends in a direction perpendicular to the axial direction of the fixing belt 80. According to this exemplary embodiment, as illustrated in FIG. 2, the nip formation pad 88, the lateral end heaters 112*a* and 112*b* illustrated as the lateral end heater 112 in FIG. 2, the stay 90, and the halogen heaters 82*a* and 82*b* constitute the nip formation assembly 86. Alternatively, the nip formation pad 88 and the lateral end heaters 112*a* and 112*b* may constitute the nip formation assembly 86.

The halogen heaters 82*a* and 82*b* and the lateral end heaters 112*a* and 112*b* are energized during an initial time of a print job of conveying sheets S continuously for fixing immediately after warming up the fixing device 150, for example, the initial time when the fixing belt 80 and the pressure roller 84 have not been heated sufficiently. Thereafter, while the sheets S are conveyed through the fixing device 150, power supply to the halogen heaters 82*a* and 82*b* and the lateral end heaters 112*a* and 112*b* is controlled based on the temperature of the fixing belt 80. In order to prevent decrease in heat output from the outboard span of the halogen heater 82*b*, a heat generator of the halogen heater 82*b* may be elongated. However, the elongated halogen heater 82*b* may overheat the non-conveyance span of the fixing belt 80 where the small sheets or the medium sheets are not conveyed over the fixing belt 80 after the small sheets or the medium sheets are conveyed over the fixing belt 80 continuously. Additionally, the elongated halogen heater 82*b* may heat the fixing belt 80 unnecessarily, wasting energy.

The lateral end heaters 112*a* and 112*b* may have a positive temperature coefficient (PTC) property. If the lateral end heaters 112*a* and 112*b* have the PTC property, a resistance value increases at a preset temperature or higher and the lateral end heaters 112*a* and 112*b* do not generate heat at the preset temperature or higher. Hence, the lateral end heaters 112*a* and 112*b* do not burn or damage the fixing belt 80, achieving the safe fixing device 150. Additionally, each of the lateral end heaters 112*a* and 112*b* situated inside the loop formed by the fixing belt 80 emits light that irradiates the inner circumferential surface of the fixing belt 80 to heat the lateral end, secondary heating spans S112 of the fixing belt 80 without degrading rotation of the fixing belt 80.

The recesses 88*a* and 88*b* supporting the lateral end heaters 112*a* and 112*b*, respectively, are coupled with the nip formation pad 88. Hence, the lateral end heaters 112*a* and 112*b* are situated inside a limited space inside the loop formed by the fixing belt 80, saving space. The metal plate 89 is mounted on the plane defined by the lateral end heaters 112*a* and 112*b* and the nip formation pad 88 leveled with the lateral end heaters 112*a* and 112*b*. Thus, the metal plate 89 having the increased thermal conductivity retains the even temperature of the fixing belt 80.

According to this exemplary embodiment, the fixing device 150 includes the two halogen heaters 82*a* and 82*b* serving as a primary heater that heats the fixing belt 80. Alternatively, the fixing device 150 may include three or more halogen heaters to correspond to various sizes of small sheets and medium sheets. Yet alternatively, the fixing device 150 may include a single halogen heater and a lateral end heater may also heat the primary heating span S82*b* of the fixing belt 80 on behalf of the halogen heater 82*b*.

A description is provided of an electric connection between the halogen heaters 82*a* and 82*b* and the lateral end heaters 112*a* and 112*b*.

Figure 9:
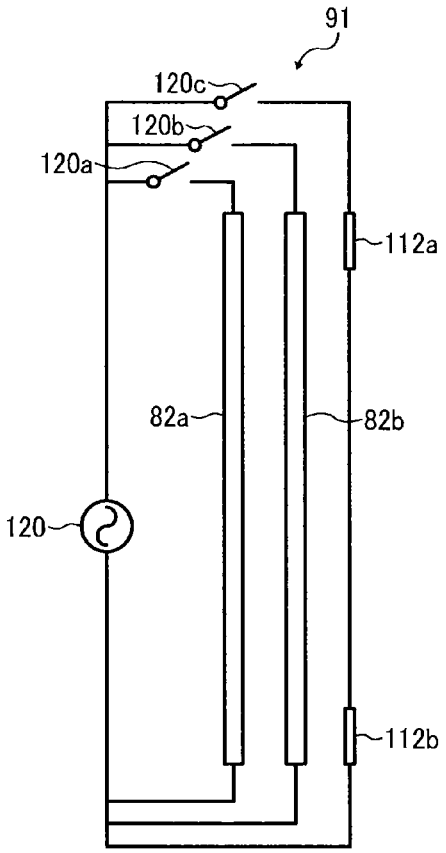
FIG. 9 is a diagram of an electric circuit illustrating an electric connection between the halogen heaters and the lateral end heaters illustrated in FIG. 5.

FIG. 9 is a diagram of an electric circuit 91 illustrating the electric connection between the halogen heaters 82*a* and 82*b* and the lateral end heaters 112*a* and 112*b* that is employed by the fixing device 150 according to the exemplary embodiments disclosed by the present disclosure. Under a center conveyance system in which the sheet S is centered in the axial direction of the fixing belt 80 as the sheet S is conveyed over the fixing belt 80, the lateral end heaters 112*a* and 112*b* are energized simultaneously. Accordingly, the lateral end heaters 112*a* and 112*b* are electrically connected in series to a power supply 120. Consequently, the lateral end heaters 112*a* and 112*b* are electrically controlled more simply compared to a control in which the lateral end heater 112*a* is powered on and off separately from the lateral end heater 112*b*. If one of the lateral end heaters 112*a* and 112*b* suffers from failure, the power supply 120 interrupts electric connection between the lateral end heaters 112*a* and 112*b* simultaneously, achieving safety of the fixing device 150. The power supply 120 powers on and off the halogen heater 82*a* through a switch 120*a* , the halogen heater 82*b* through a switch 120*b*, and the lateral end heaters 112*a* and 112*b* through a switch 120*c*.

As illustrated in FIG. 5, according to the exemplary embodiments of the present disclosure, the single lateral end heater 112*a* is disposed opposite one lateral end of the fixing belt 80 in the axial direction thereof; the single lateral end heater 112*b* is disposed opposite another lateral end of the fixing belt 80 in the axial direction thereof. Alternatively, a plurality of lateral end heaters 112*a* may be disposed opposite one lateral end of the fixing belt 80 in the axial direction thereof and a plurality of lateral end heaters 112*b* may be disposed opposite another lateral end of the fixing belt 80 in the axial direction thereof according to various sizes of sheets S, for example. Yet alternatively, each of the lateral end heaters 112*a* and 112*b* may be disposed outboard from the halogen heater 82*b* in a longitudinal direction thereof farther than the lateral end heaters 112*a* and 112*b* illustrated in FIG. 5. Accordingly, the lateral end heaters 112*a* and 112*b* correspond to an increased number of sizes of sheets S and heat the fixing belt 80 precisely.

As illustrated in FIG. 2, a temperature sensor 125 is disposed opposite and in proximity to an outer circumferential surface of the fixing belt 80. The electric circuit 91 depicted in FIG. 9 controls the halogen heaters 82*a* and 82*b* and the lateral end heaters 112*a* and 112*b* based on the temperature of the fixing belt 80 detected by the temperature sensor 125. As illustrated in FIG. 2, a safety device such as a thermostat 126 is disposed opposite and in proximity to the outer circumferential surface of the fixing belt 80 to prevent the temperature sensor 125 from being out of control when the temperature sensor 125 suffers from failure.

As described above, according to the first exemplary embodiment, even if a heating performance of the lateral end heaters 112*a* and 112*b* is lower than a heating performance of the halogen heaters 82*a* and 82*b*, the electric circuit 91 energizes the lateral end heaters 112*a* and 112*b* separately from the halogen heaters 82*a* and 82*b*. Accordingly, the electric circuit 91 controls the lateral end heaters 112*a* and 112*b* and the halogen heaters 82*a* and 82*b* to cause the lateral end heaters 112*a* and 112*b* to heat the secondary heating spans S 112 of the fixing belt 80 to a temperature identical to a temperature of the primary heating spans S82*a* and S82*b* of the fixing belt 80 heated by the halogen heaters 82*a* and 82*b*, respectively, thus improving flexibility in selective energization of the lateral end heaters 112*a* and 112*b* and the halogen heaters 82*a* and 82*b*.

A description is provided of a heat generation distribution of the lateral end heater 112 representing the lateral end heaters 112*a* and 112*b*.

Figure 10:
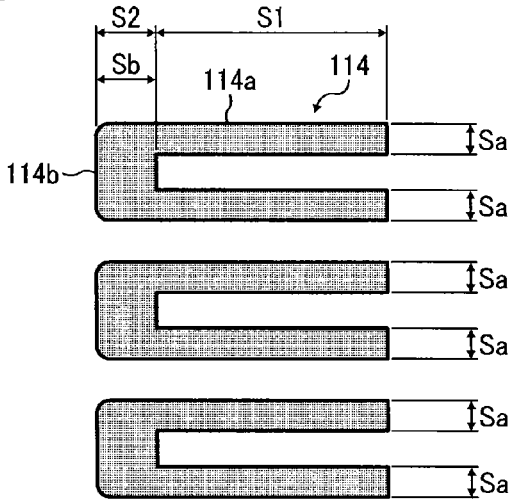
FIG. 10 is a schematic plan view of a resistive heat generator of the lateral end heater illustrated in FIG. 7A.

FIG. 10 is a schematic plan view of the resistive heat generator 114 of the lateral end heater 112 illustrating the circuit of the resistive heat generator 114 that is turned and directed to the center of the fixing belt 80 in the axial direction. As illustrated in FIG. 10, the resistive heat generator 114 includes a straight portion 114*a* serving as a major heat generator and a U-shaped turn portion 114*b* serving as a minor heat generator. A cross-sectional area Sb of the turn portion 114*b* is greater than a cross-sectional area Sa of the straight portion 114*a*. The turn portion 114*b* is disposed inboard from the straight portion 114*a* in the axial direction of the fixing belt 80. Since a resistance value of a conducting wire is inversely proportional to a cross-sectional area, when the resistive heat generator 114 is applied with power, a heat generation amount per unit length of the turn portion 114*b* in a longitudinal direction of the resistive heat generator 114 parallel to the axial direction of the fixing belt 80 is smaller than that of the straight portion 114*a*.

According to this exemplary embodiment, variation in the cross-sectional area of the resistive heat generator 114 changes the resistance value to adjust an amount of power supplied to the resistive heat generator 114. Alternatively, the conducting wire may be produced by joining materials having different electric resistivities, respectively, to change the resistance value. Yet alternatively, the circuit of the resistive heat generator 114 may be a parallel circuit or the like. As illustrated in FIG. 10, the turn portion 114*b* has an increased cross-sectional area. Alternatively, the straight portion 114*a* may include a plurality of sections having different cross-sectional areas, respectively, to adjust the heat generation amount of the resistive heat generator 114.

A description is provided of advantages of the resistive heat generator 114 constructed of the straight portion 114*a* and the turn portion 114*b*.

Figure 11A:
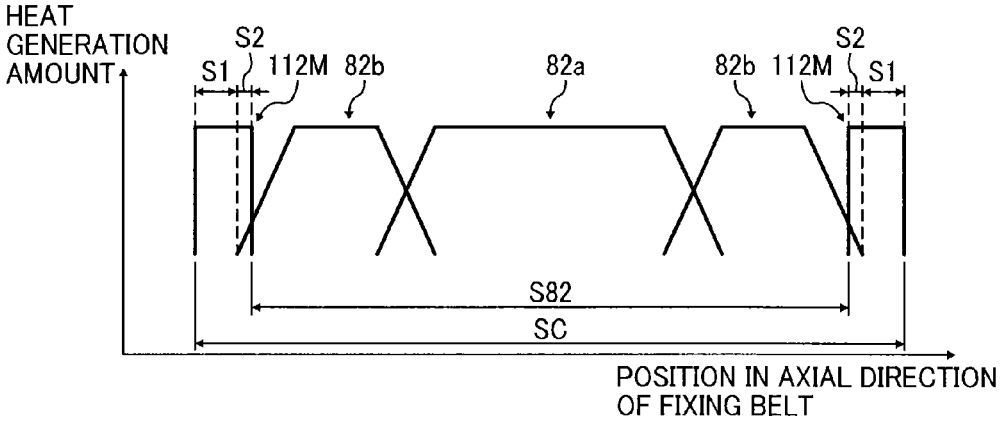
FIG. 11A is a graph illustrating a relation between a position in an axial direction of a fixing belt of the fixing device illustrated in FIG. 2 and a heat generation amount of the halogen heaters illustrated in FIG. 5 and comparative lateral end heaters.
Figure 11B:
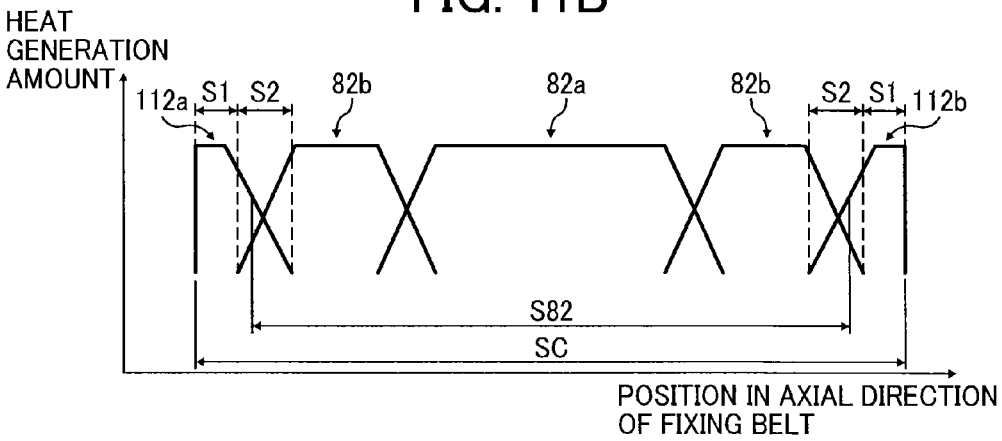
FIG. 11B is a graph illustrating a relation between the position in the axial direction of the fixing belt and the heat generation amount of the halogen heaters and the lateral end heaters illustrated in FIG. 5.

FIGS. 11A and 11B illustrate a heat generation distribution of the halogen heaters 82*a* and 82*b* and the lateral end heaters 112*a* and 112*b* in the axial direction of the fixing belt 80. FIG. 11A is a graph illustrating a relation between a position in the axial direction of the fixing belt 80 and a heat generation amount of the halogen heaters 82*a* and 82*b* and comparative lateral end heaters 112M, each of which incorporates a comparative resistive heat generator having a uniform cross-sectional area. FIG. 11B is a graph illustrating a relation between the position in the axial direction of the fixing belt 80 and the heat generation amount of the halogen heaters 82*a* and 82*b* and the lateral end heaters 112*a* and 112*b*, each of which incorporates the resistive heat generator 114 illustrated in FIG. 10. In FIGS. 11A and 11B, reference numerals 82*a*, 82*b*, 112M, 112*a*, and 112*b* indicate the heat generation amount of the halogen heaters 82*a* and 82*b*, the comparative lateral end heaters 112M, and the lateral end heaters 112*a* and 112*b*, respectively.

Each of the halogen heaters 82*a* and 82*b* has a heat generation property in which a heat generation amount of each lateral end of the respective halogen heaters 82*a* and 82*b* in the axial direction of the fixing belt 80 is smaller than a heat generation amount of a center of the respective halogen heaters 82*a* and 82*b* in the axial direction of the fixing belt 80, resulting in decrease in heat generation amount at each lateral end of the respective halogen heaters 82*a* and 82*b* in the axial direction of the fixing belt 80. Accordingly, as illustrated in FIG. 11A, a heat generator of the halogen heater 82*b* overlaps a heat generator of the comparative lateral end heater 112M in the axial direction of the fixing belt 80 to define a bi-heating span S2, that is, an overlap span, where both the halogen heater 82*b* and the comparative lateral end heater 112M heat the fixing belt 80. The fixing belt 80 may receive an increased amount of heat in the bi-heating span S2 compared to other span and therefore may overheat in the bi-heating span S2. On the other hand, the fixing belt 80 may suffer from shortage of heat in a span not heated by the comparative lateral end heater 112M due to decrease in heat generation amount at the lateral end of the halogen heater 82*b* in the axial direction of the fixing belt 80. Accordingly, when the halogen heaters 82*a* and 82*b* and the comparative lateral end heater 112M are energized to cause the fixing belt 80 to heat a large sheet S such as the A3 extension size sheet, the fixing belt 80 may suffer from uneven temperature in a span in proximity to the bi-heating span S2, resulting in faulty fixing, such as variation in gloss of the toner image on the large sheet S, and degradation in quality of the toner image fixed on the large sheet S, such as insufficient fixing at a low temperature lower than a desired fixing temperature.

Conversely, each of the lateral end heaters 112*a* and 112*b* incorporating the resistive heat generator 114 depicted in FIG. 10 attains a resistance value in the bi-heating span S2 that is smaller than a resistance value in a mono-heating span Si of the fixing belt 80 in the axial direction thereof where only the lateral end heaters 112*a* and 112*b* heat the fixing belt 80.

Thus, a heat generation amount of the resistive heat generator 114 in the bi-heating span S2 is smaller than a heat generation amount of the resistive heat generator 114 in the mono-heating span S 1. Accordingly, the heat generation amount of the lateral end heaters 112*a* and 112*b* changes gently in the axial direction of the fixing belt 80. The lateral end heaters 112*a* and 112*b* achieve the heat generation distribution that offsets decrease in heat generation amount at each lateral end of the halogen heater 82*b* in the axial direction of the fixing belt 80. Thus, the lateral end heaters 112*a* and 112*b* even the temperature of the fixing belt 80 in the axial direction thereof Consequently, the lateral end heaters 112*a* and 112*b* reduce variation in temperature of the fixing belt 80 in the axial direction thereof, preventing fixing failure and retaining improved quality of the toner image formed on the sheet S.

As illustrated in FIG. 10, the resistance value of the turn portion 114*b* disposed opposite the bi-heating span S2 is smaller than the resistance value of the straight portion 114*a* disposed opposite the mono-heating span S1, attaining the above-described simple configuration of the lateral end heaters 112*a* and 112*b*. The cross-sectional area of the turn portion 114*b* disposed opposite the bi-heating span S2 is smaller than the cross-sectional area of the straight portion 114*a* disposed opposite the mono-heating span S1, attaining the above-described configuration of the resistive heat generator 114 with simple modification of a circuit of the comparative resistive heat generator of the comparative lateral end heater 112M.

Figure 12:
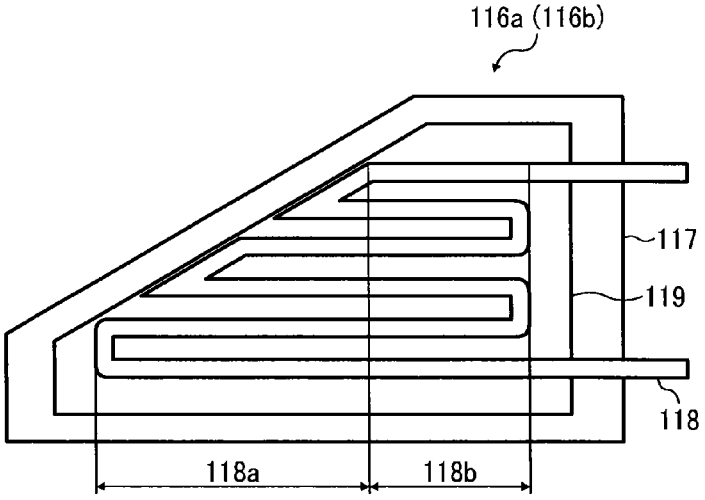
FIG. 12 is a plan view of a lateral end heater according to a second exemplary embodiment of the present disclosure.

Referring to FIG. 12, a description is provided of a configuration of lateral end heaters 116*a* and 116*b* according to a second exemplary embodiment.

FIG. 12 is a plan view of the lateral end heaters 116*a* and 116*b* serving as a secondary heater. The lateral end heaters 116*a* and 116*b* are installed in the fixing device 150 depicted in FIG. 2 instead of the lateral end heaters 112*a* and 112*b*. Unlike the rectangular lateral end heater 112 depicted in FIG. 7A, each of the trapezoidal lateral end heaters 116*a* and 116*b* includes a ceramic base 117 instead of the ceramic base 113 and an insulative layer 119 instead of the insulative layer 115. Unlike the ceramic base 113 and the insulative layer 115 that are rectangular, the ceramic base 117 and the insulative layer 119 are trapezoidal. For example, each of the ceramic base 117 and the insulative layer 119 is contoured in a trapezoid produced by removing one corner of a rectangle that is directed to the center of the fixing belt 80 in the axial direction thereof. Each of the lateral end heaters 116*a* and 116*b* further includes a resistive heat generator 118 instead of the resistive heat generator 114. The resistive heat generator 118 has a wiring layout corresponding to the trapezoidal ceramic base 117 and the trapezoidal insulative layer 119.

The resistive heat generator 118 includes a decreased area portion 118*a* serving as a minor heat generator and an increased area portion 118*b* serving as a major heat generator. The decreased area portion 118*a* is produced by removing the one corner of the rectangle and has a wiring density per unit length in a longitudinal direction of the resistive heat generator 118 parallel to the axial direction of the fixing belt 80 which is smaller than that of the increased area portion 118*b*. Additionally, a contact area where the decreased area portion 118*a* contacts the fixing belt 80 is smaller than a contact area where the increased area portion 118*b* contacts the fixing belt 80. Accordingly, a heat generation amount of the decreased area portion 118*a* is smaller than a heat generation amount of the increased area portion 118*b*, causing the heat generation amount of the lateral end heaters 116*a* and 116*b* to change gently in the bi-heating span S2 like the lateral end heaters 112*a* and 112*b* according to the first exemplary embodiment. Consequently, the heat generation amount of the lateral end heaters 116*a* and 116*b* changes gently in the axial direction of the fixing belt 80. The lateral end heaters 116*a* and 116*b* achieve a heat generation distribution that offsets decrease in heat generation amount at each lateral end of the halogen heater 82*b* in the axial direction of the fixing belt 80. Thus, the lateral end heaters 116*a* and 116*b* even the temperature of the fixing belt 80 in the axial direction thereof.

The decreased area portion 118*a* disposed opposite the bi-heating span S2 has a decreased wiring density to decrease the heat generation amount of a part of the resistive heat generator 118, attaining advantages equivalent to the advantages of the resistive heat generator 114 of the lateral end heater 112 according to the first exemplary embodiment readily. The decreased area portion 118*a* decreases the area where the resistive heat generator 118 contacts the fixing belt 80 in the bi-heating span S2, decreasing the heat generation amount of a part of the resistive heat generator 118 and thus attaining the advantages equivalent to the advantages of the resistive heat generator 114 of the lateral end heater 112 according to the first exemplary embodiment readily.

According to the exemplary embodiments described above, the halogen heaters 82*a* and 82*b* are used as a primary heater. Alternatively, a heater having a lateral end that generates a decreased amount of heat compared to a center of the heater in a longitudinal direction thereof may be used as a primary heater that attains the advantages described above. For example, an induction heating (IH) coil or the like may be used as a primary heater. Even if the IH coil isolated from the outer circumferential surface of the fixing belt 80 heats the fixing belt 80 by electromagnetic induction, a property of a magnetic field generated by electromagnetic induction may decrease the heat generation amount at each lateral end of the IH coil in the axial direction of the fixing belt 80. Hence, the above-described configuration of the lateral end heaters 112*a*, 112*b*, 116*a*, and 116*b* may be applied to the IH coil to achieve the advantages described above. According to the exemplary embodiments described above, the halogen heaters 82*a* and 82*b* heat the fixing belt 80 directly. Alternatively, a sleeve or the like may be interposed between the halogen heaters 82*a* and 82*b* and the fixing belt 80 so that the halogen heaters 82*a* and 82*b* heat the fixing belt 80 via the sleeve or the like. Yet alternatively, the fixing belt 80 may be looped over a heating roller so that the halogen heaters 82*a* and 82*b* heat the heating roller which in turn heats the fixing belt 80.

The present disclosure is not limited to the details of the exemplary embodiments described above and various modifications and improvements are possible. The advantages achieved by the exemplary embodiments described above are examples and therefore are not limited to those described above.

A description is provided of advantages of the fixing device 150.

As illustrated in FIG. 2, the fixing device 150 includes a fixing rotator or a flexible endless belt (e.g., the fixing belt 80) rotatable in a predetermined direction of rotation and a pressure rotator (e.g., the pressure roller 84) disposed opposite the fixing rotator to press against the fixing rotator to form the fixing nip N therebetween, through which a recording medium (e.g., a sheet S) bearing a toner image is conveyed.

As illustrated in FIG. 5, a primary heater (e.g., the halogen heaters 82*a* and 82*b*) is disposed opposite the primary heating span S82 spanning the primary heating spans S82*a* and S82*b* of the fixing rotator in an axial direction thereof to heat a circumferential span of the fixing rotator other than the fixing nip N. For example, the primary heating span S82 is a center span of the fixing rotator in the axial direction thereof. A secondary heater (e.g., the lateral end heaters 112*a*, 112*b*, 116*a*, and 116*b*) is disposed opposite the secondary heating span S112 of the fixing rotator in the axial direction of the fixing rotator to heat the fixing rotator at the fixing nip N. For example, the secondary heating span S112 is a lateral end span of the fixing rotator in the axial direction thereof.

As illustrated in FIGS. 10 and 11B, the fixing rotator has the bi-heating span S2 and the mono-heating span 51 in the axial direction of the fixing rotator. The bi-heating span S2 of the fixing rotator is heated by the primary heater and the secondary heater. The mono-heating span S1 of the fixing rotator is heated by the secondary heater only. The secondary heater generates a decreased amount of heat to be conducted to the bi-heating span S2 of the fixing rotator that is smaller than an increased amount of heat to be conducted to the mono-heating span S1 of the fixing rotator.

The secondary heater achieves a heat generation distribution that offsets decrease in heat generation amount at a lateral end of the primary heater in the axial direction of the fixing rotator. Thus, the secondary heater evens the temperature of the fixing rotator in the axial direction thereof. Accordingly, the secondary heater reduces variation in temperature of the fixing rotator in the axial direction thereof, preventing fixing failure and retaining improved quality of the toner image formed on the recording medium.

As illustrated in FIG. 5, the fixing device 150 employs the center conveyance system in which the sheet S is centered on the fixing belt 80 in the axial direction thereof. Accordingly, the halogen heater 82*a* is disposed opposite the primary heating span S82*a*, that is, the center span of the fixing belt 80 in the axial direction thereof. The halogen heater 82*b* is disposed opposite the primary heating span S82*b*, that is, each lateral end span of the fixing belt 80 in the axial direction thereof. Each of the lateral end heaters 112*a* and 112*b* is disposed opposite the secondary heating span S112, that is, each lateral end span of the fixing belt 80 that is outboard from the primary heating span S82*b* in the axial direction of the fixing belt 80. Alternatively, the fixing device 150 may employ a lateral end conveyance system in which the sheet S is conveyed in the sheet conveyance direction DS along one lateral end of the fixing belt 80 in the axial direction thereof. In this case, one of heat generators of the halogen heater 82*b* and one of the lateral end heaters 112*a* and 112*b* are eliminated. Another one of the heat generators of the halogen heater 82*b* and another one of the lateral end heaters 112*a* and 112*b* are distal from the lateral end of the fixing belt 80 in the axial direction thereof According to the exemplary embodiments described above, the fixing belt 80 serves as a fixing rotator. Alternatively, a fixing roller, a fixing film, a fixing sleeve, or the like may be used as a fixing rotator. Further, the pressure roller 84 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

a pressure rotator to press against the fixing rotator to form a fixing nip between the fixing rotator and the pressure rotator;

a primary heater disposed opposite the fixing rotator to heat a circumferential span of the fixing rotator other than the fixing nip; and a secondary heater disposed outboard from the primary heater in an axial direction of the fixing rotator to heat the fixing rotator at the fixing nip, the primary heater and the secondary heater to heat a bi-heating span of the fixing rotator in the axial direction of the fixing rotator, the bi-heating span including a central region where the secondary heater does not exist, the secondary heater to heat a mono-heating span of the fixing rotator in the axial direction of the fixing rotator, the mono-heating span being an outer portion span which is outside of the central region, and where the primary heater does not exist, and the secondary heater to generate a decreased amount of heat to be conducted to the bi-heating span of the fixing rotator, the decreased amount of heat being smaller than an increased amount of heat to be conducted to the mono-heating span of the fixing rotator that is heated solely by the secondary heater.

2. The fixing device according to claim 1, wherein the secondary heater includes a resistive heat generator to generate heat.

3. The fixing device according to claim 2, wherein the resistive heat generator includes:

a major heat generator, disposed opposite the mono-heating span of the fixing rotator, to generate the increased amount of heat; and a minor heat generator, disposed opposite the bi-heating span of the fixing rotator, to generate the decreased amount of heat.

4. The fixing device according to claim 3, wherein a resistance value of the minor heat generator is smaller than a resistance value of the major heat generator.

5. The fixing device according to claim 3, wherein a cross-sectional area of the minor heat generator is greater than a cross-sectional area of the major heat generator.

6. The fixing device according to claim 3, wherein a wiring density of the minor heat generator is smaller than a wiring density of the major heat generator in the axial direction of the fixing rotator.

7. The fixing device according to claim 3, wherein a contact area where the minor heat generator contacts the fixing rotator is smaller than a contact area where the major heat generator contacts the fixing rotator.

8. The fixing device according to claim 3, wherein the minor heat generator is inboard from the major heat generator in the axial direction of the fixing rotator.

9. The fixing device according to claim 3, wherein the minor heat generator is directed to a center of the fixing rotator in the axial direction of the fixing rotator and the major heat generator is directed to a lateral edge of the fixing rotator in the axial direction of the fixing rotator.

10. The fixing device according to claim 1, wherein the primary heater heats a center span of the fixing rotator in the axial direction of the fixing rotator and the secondary heater heats each lateral end span of the fixing rotator in the axial direction of the fixing rotator.

11. The fixing device according to claim 1, wherein the secondary heater is rectangular.

12. The fixing device according to claim 1, wherein the secondary heater is trapezoidal.

13. The fixing device according to claim 1, further comprising a thermal conductor sandwiched between the secondary heater and the fixing rotator to conduct heat from the secondary heater to the fixing rotator evenly.

14. The fixing device according to claim 1,
wherein the fixing rotator includes a flexible endless belt.

15. A fixing device comprising:
a fixing rotator rotatable in a predetermined direction of rotation;
a pressure rotator to press against the fixing rotator to form a fixing nip between the fixing rotator and the pressure rotator;
a primary heater disposed opposite the fixing rotator to heat a circumferential span of the fixing rotator other than the fixing nip; and
a secondary heater disposed outboard from the primary heater in an axial direction of the fixing rotator to heat the fixing rotator at the fixing nip,
the primary heater and the secondary heater to heat a bi-heating span of the fixing rotator in the axial direction of the fixing rotator,
the secondary heater to heat a mono-heating span of the fixing rotator in the axial direction of the fixing rotator and generate a decreased amount of heat to be conducted to the bi-heating span of the fixing rotator, the decreased amount of heat being smaller than an increased amount of heat to be conducted to the mono-heating span of the fixing rotator that is heated solely by the secondary heater of the primary heater and the secondary heater,
wherein the fixing rotator includes a flexible endless belt,
wherein the fixing device further comprises a nip formation pad to press against the pressure rotator via the endless belt to form the fixing nip,
wherein the secondary heater is leveled with the nip formation pad to define a substantially identical plane.

16. The fixing device according to claim 15,
wherein the nip formation pad includes a recess accommodating the secondary heater.

17. The fixing device according to claim 16,
wherein the secondary heater includes:
a ceramic base;
a resistive heat generator mounted on the ceramic base to generate heat; and
an insulative layer mounted on the resistive heat generator and contacting the recess of the nip formation pad.

18. An image forming apparatus comprising:
an image bearer to bear a toner image;
a fixing rotator disposed downstream from the image bearer in a recording medium conveyance direction and rotatable in a predetermined direction of rotation;
a pressure rotator to press against the fixing rotator to form a fixing nip between the fixing rotator and the pressure rotator;
a primary heater disposed opposite the fixing rotator to heat a circumferential span of the fixing rotator other than the fixing nip;
a secondary heater disposed outboard from the primary heater in an axial direction of the fixing rotator to heat the fixing rotator at the fixing nip; and
an electric circuit electrically connected to the primary heater and the secondary heater to energize the primary heater and the secondary heater,
the primary heater and the secondary heater to heat a bi-heating span of the fixing rotator in the axial direction of the fixing rotator,
the secondary heater to heat a mono-heating span of the fixing rotator in the axial direction of the fixing rotator and generate a decreased amount of heat to be conducted to the bi-heating span of the fixing rotator, the decreased amount of heat being smaller than an increased amount of heat to be conducted to the mono-heating span of the fixing rotator that is heated solely by the secondary heater of the primary heater and the secondary heater,
wherein the fixing rotator includes a flexible endless belt,
wherein the fixing device further comprises a nip formation pad to press against the pressure rotator via the endless belt to form the fixing nip,
wherein the secondary heater is leveled with the nip formation pad to define a substantially identical plane.

19. The image forming apparatus according to claim 18,
wherein the secondary heater is electrically connected in series.

20. The image forming apparatus according to claim 19,
wherein the electric circuit energizes the secondary heater separately from the primary heater.

* * * * *